United States Patent [19]

De Vera

[11] Patent Number: 4,536,953

[45] Date of Patent: Aug. 27, 1985

[54] SWITCHING MECHANISM AND METHOD OF MAKING SAME

[75] Inventor: Dennis De Vera, Mundelein, Ill.

[73] Assignee: Eaton Corporation, Cleveland, Ohio

[21] Appl. No.: 547,560

[22] Filed: Oct. 31, 1983

[51] Int. Cl.[3] ..... H01H 11/00; H01H 1/36

[52] U.S. Cl. ..... 29/622; 200/252

[58] Field of Search ..... 200/252; 29/622, 418, 29/412, 413, 33 M

[56] References Cited

U.S. PATENT DOCUMENTS

| | | | |
|---|---|---|---|
| 3,967,370 | 7/1976 | Griffin et al. | 29/622 |
| 3,983,930 | 10/1976 | Franz | 165/31 |
| 4,118,859 | 10/1978 | Busler | 29/622 |
| 4,197,804 | 4/1980 | Uhlig et al. | 29/882 |
| 4,307,275 | 12/1981 | Larson et al. | 29/622 |

*Primary Examiner*—Howard N. Goldberg
*Assistant Examiner*—Steven Nichols
*Attorney, Agent, or Firm*—C. H. Grace; R. A. Johnston

[57] ABSTRACT

A slide-type electrical switching mechanism has a contact plate with a plurality of frangible portions interconnecting discrete electrical contacts. The plate is securred to the non-conducting slider housing by deforming portions of the housing over the plate. The frangible portions are then punched out to form a plurality of discrete contacts for switching. The plate has contact connectors formed integrally therewith.

5 Claims, 10 Drawing Figures

SWITCHING MECHANISM AND METHOD OF MAKING SAME

BACKGROUND OF THE INVENTION

The present invention relates to electrical switching devices and particularly to switching devices having a sliding wiper contact for movement along a plurality of spaced stationary contact strips. Such slide type switching mechanism are known to be employed in electrical programmers for controlling the duty cycle functions of automotive air conditioning and temperature control systems.

In providing electrical programmers for automotive temperature control systems, it is known to provide a fluid pressure operated actuator for moving a slider block for an electrical switching mechanism. Typically, such a device employs a vacuum motor having an actuator rod or wire extending from the motor diaphragm and interconnected with the movable slider of the electrical programming switch. The movable slider has a conductive wiper thereon for bridging stationary discrete contacts on the housing of the switching mechanism for providing the desired switching functions as the movable slider is moved in response to movement of the vacuum motor actuator.

In designing slide type switching mechanism suitable for automotive temperature control system programmers, it has been required to provide a plurality of individual stationary contact strips attached to the switch housing for making contact with the wipers provided on the switch slider. This known construction technique has required the forming, placing and positioning of individual thin metal contact strips into the switch housing and providing means for retaining each of the individual contact strips therein. Heretofore, upon placement and positioning of the individual contact strip, it has been necessary to provide tabs received through apertures in the housing for bending of the tab after placement of the strip onto the housing to retain the strip thereon. Alternatively, the individual contact strips may be retained on the switch housing by one or more rivets received through apertures in the strip and housing.

The aforesaid switch construction employing individual stationary contact strips, for traverse by a sliding wiper contact, has resulted in difficult assembly operations in mass production in the placement and retaining of each of the individual stationary contact strips. Furthermore, the requirement of individually placing and retaining the contact strips on the switch housing has resulted in successive hand assembly operations which inherently yield high manufacturing costs in mass production.

There has thus existed a long felt need to provide an electrical switching mechanism of the sliding wiper type and for providing such a switching mechanism which was capable of high speed easily assembled low cost fabrication in volume production. In particular, there has been a need for a way or means of providing such a switching mechanism of the type having a plurality stationary individual contact strips mounted on the switch housing for making contact with a sliding wiper.

SUMMARY OF THE INVENTION

The present invention relates to electrical switching devices and particularly switches of the type having a sliding wiper for effecting electrical switching between a plurality of stationary contact strips. The switching mechanism disclosed herein is of the type particularly suitable for application in an automotive temperature control system wherein the sliding wiper portion is moved by a fluid pressure actuator as such as a vacuum motor.

The switching mechanism disclosed herein employs a slider block having mounted thereon a bridging electrical contact for effecting switching by wiping stationary strips having discrete contacts provided thereon.

The housing of the switching device of the present invention has mounted thereon a relatively thin plate of electrical contact material having frangible portions thereof interconnecting discrete integrally formed contacts. The plate has other integral portions thereof forming electrical connectors adapted for external connection thereto. The plate is received in the housing with the electrical connector portions extending into recesses provided therefor. The plate is positioned and retained in the housing by deforming, preferably by heating, integral portions of the housing thereover. The frangible portions of the plate are then punched out to remove the interconnections thereby leaving a plurality of individual contact strips electrically isolated from each other on the housing.

The novel and unique construction of the switching device of the present invention enables a plurality of individual contact strips to be formed initially interconnected by frangible webs as a unitary plate. Upon assembly of the plate into the switch housing, and removal of the frangible interconnections, a plurality of discrete electrically isolated contact strips are formed in the housing without the necessity of handling and assembling individual strips into the switch housing.

DETAILED DESCRIPTION

Figure 1:
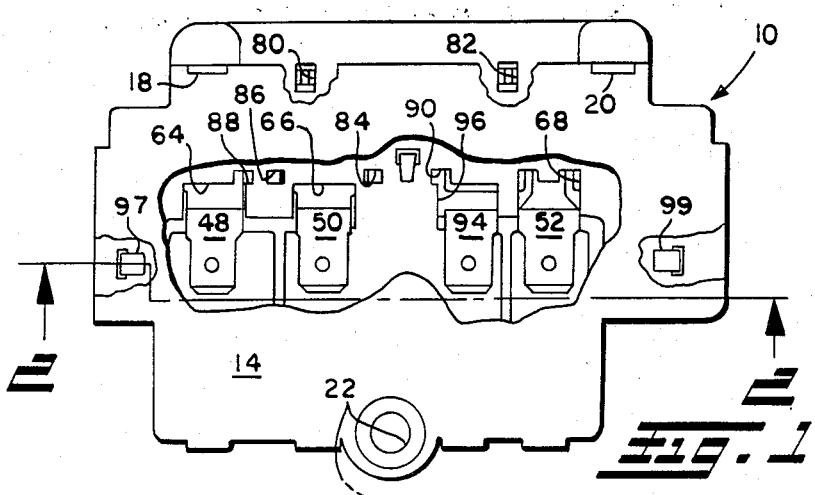
FIG. 1 is a top view of the switch assembly of the present invention with portions of the cover broken away.
Figure 3:
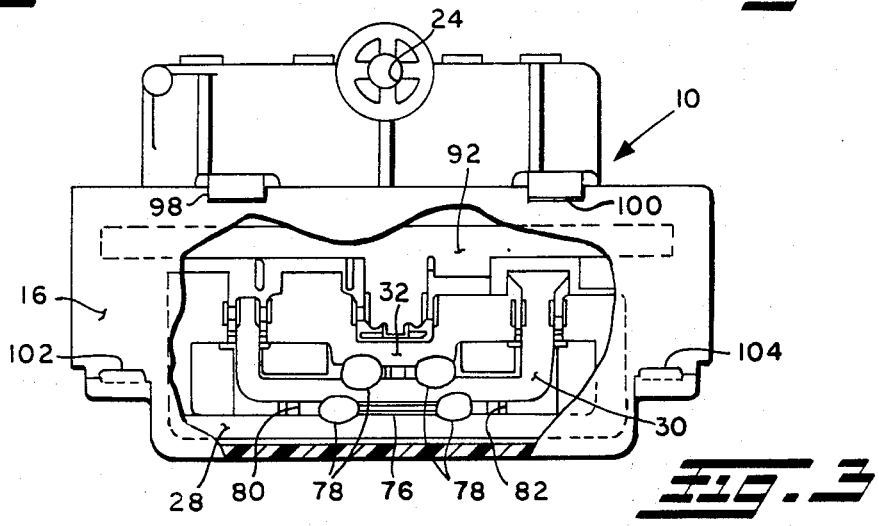
FIG. 3 is a view taken along section-indicating lines 3—3 of FIG. 2 with portions of the bottom of the switch housing broken away.
Figure 4:
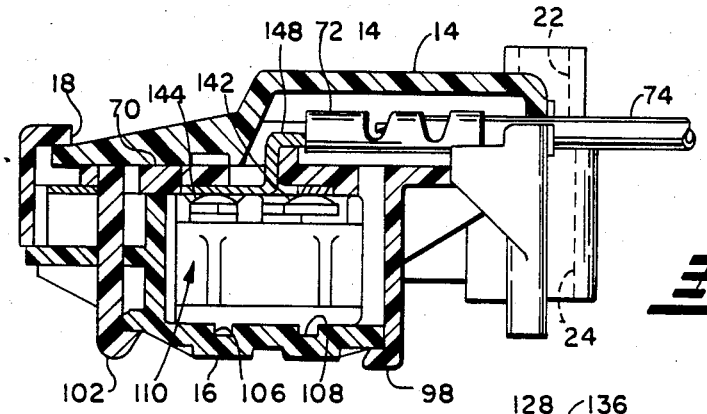
FIG. 4 is an end view taken along section-indicating lines 4—4 of FIG. 2.

Referring now to FIG. 1, the switch assembly of the present invention, indicated generally at 10, has a housing comprising a base 12, top cover 14 and bottom cover or shell 16. The top cover 14 is retained over the base 12 by engagement with a pair of lugs 18, 20 provided on the body and a suitable fastening means (not shown) received through aperture 22 formed in the cover, and a corresponding aperture 24 formed in the base 12 and aligned therewith as shown in FIGS. 3 and 4.

With reference to FIGS. 1–4, 9 and 10, a thin plate indicated generally at 26 is formed of electrically conductive material and has a plurality of conductive strips 28, 30 and 32 integrally formed thereon. The strips 28, 30 and 32 are interconnected by frangible sections 34, 36, 38, 40, 42, 44 and 46, which frangible portions are indicated as being formed by the dashed lines in FIG. 9. Each of the strips 28, 30 and 32 has an electrical connecting portion 48, 52 and 50, respectively, extending therefrom and having a generally Z-shaped orientation. One of the terminals 52 is shown in the end view of plate 26 illustrated in FIG. 10.

The terminal strips 28, 30 and 32 are configured to form a plurality of apertures 54, 56, 58, 60 and 62 in the plate in conjunction with the frangible portions.

Figure 2:
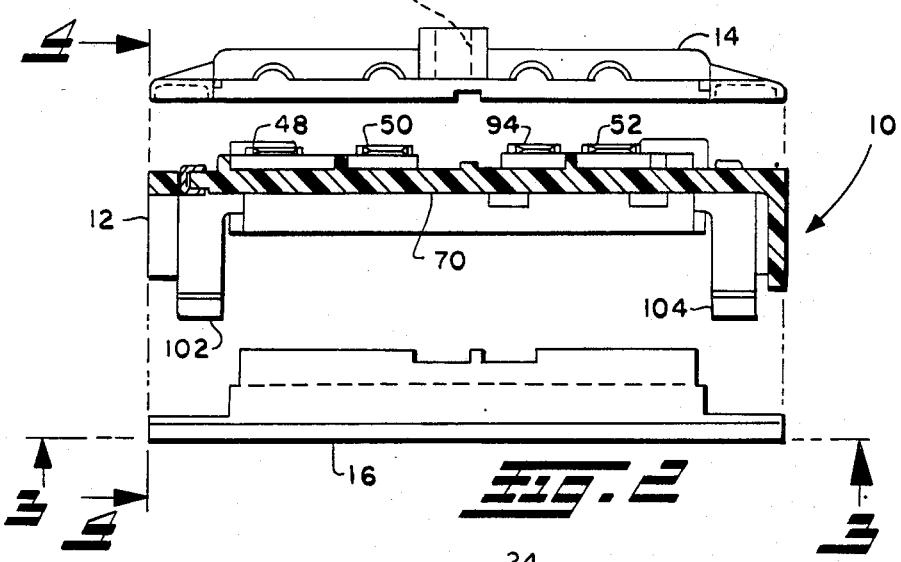
FIG. 2 is an exploded section view taken along section-indicating lines 2—2 of FIG. 1.

Referring now particularly to FIGS. 1–4, the plate 26 is assembled onto the body by passing the connector portions or tabs 48, 50 and 52 through apertures 64, 66 and 68 respectively, provided through the deck 70 of the body. The connector portions 48, 50 and 52 extend generally parallel to deck 70 as shown in FIG. 1 and FIG. 2.

Referring particularly to FIG. 4, the terminals 48, 50 and 52 each have an electrical connector received thereover such as connector 72 and have a lead attached thereto such as lead 74 shown connected to the connector terminal 48.

Referring particularly to FIG. 3, the deck 70 of the body 12 has a plurality of lugs, such as the lug 76, extending downwardly from the lower face thereof, so as to be received through apertures 58, 56 and 60 in the plate. In the presently preferred practice, the body 12 is formed of suitable thermoplastic material and the portions of the lugs, such as lug 76, extending through the plate 26 are deformed thereover in a suitable manner such as by hot melting to retain the plate 26 onto the deck of the body. In the presently preferred practice of the invention, the body 12 and deck 70 are made of plastic material and the lugs such as 76 are heat staked to form nodules denoted by the numeral 78 in FIG. 3.

The deck 70 has a plurality of cutouts or apertures indicated by reference numerals 80, 82, 84, 86 and 88, which are each disposed directly under one of the frangible portions of the plate 26 to provide access thereto. The apertures 80–90 permit the frangible portions 34–36 of the plate 26 to be removed by punching after installation of the plate 26 onto the deck 70 of the housing. The removal of the frangible portions thus forms the discrete contact strips 28, 30 and 32 which are then electrically isolated from each other.

A separate common electrical switch contact strip is provided as indicated by the numeral 92 in FIG. 3, which strip has attached thereto an electrical connector tab 94 to extend through aperture 96 formed in the deck 70 as shown in FIGS. 1 and 2. The common contact strip 92 extends substantially the length of the body 12 as shown in solid and dashed outline in FIG. 3 and is retained thereon by tabs 97, 99 received through the deck 70.

The bottom cover or shell 16 is retained on the body by a pair of spaced lugs 98, 100 with the edge of the lower shell 16 received thereunder as illustrated in FIGS. 3 and 4. A second pair of lugs in the form of snap-locking tabs 102, 104 are provided on the body and extend therefrom to engage the opposite edge of the shell 16 as shown in FIGS. 3 and 4 for retaining the shell in position on the body.

The shell 16 has provided on the inner surface thereof a pair of spaced longitudinally extending grooves 106, 108 as illustrated in FIG. 4.

Referring now to FIG. 4–8, the wiper subassembly is illustrated as having a sliding block 112 with a pair of spaced ways or rails 114, 116 provided thereon and extending from the lower surface thereof.

Figure 7:
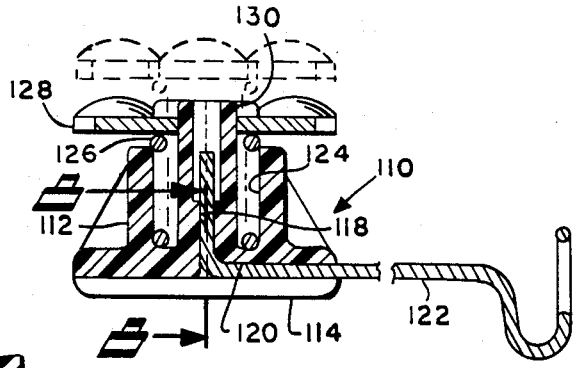
FIG. 7 is a section view taken along section-indicating lines 7—7 in FIG. 5.
Figure 8:
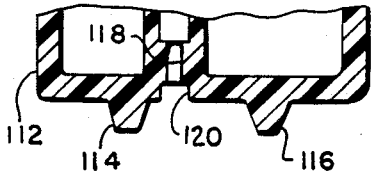
FIG. 8 is a section view taken along section-indicating lines 8—8 of FIG. 7 with the actuating wire removed.
Figure 9:
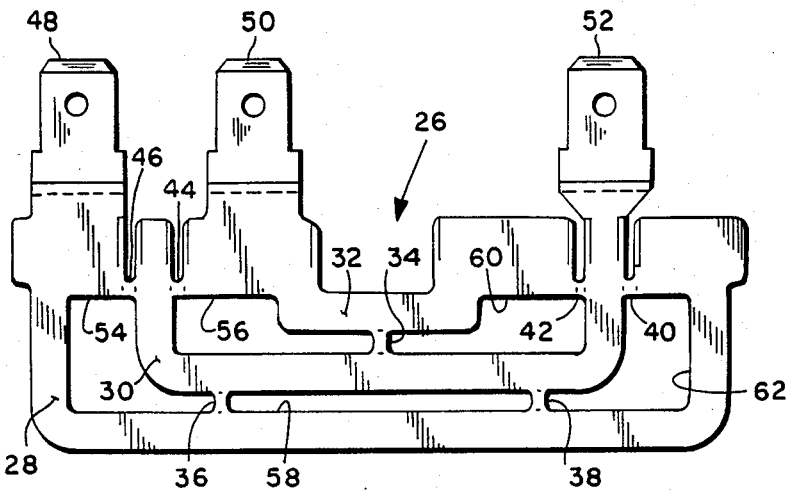
FIG. 9 is a plan view of the contact plate as formed prior to assembly.
Figure 10:
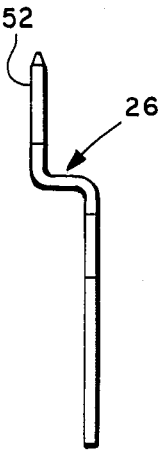
FIG. 10 is an end view of the formed plate of FIG. 9.

Referring particularly to FIGS. 7 and 8, the sliding block 112 has a centrally located vertically disposed bore 118 provided therein which connects with a groove 120 provided on the lower surface thereof and disposed intermediate ways 114, 116. The bore 118 and groove 120 have received therein a connecting link in the form of wire 122 as shown in FIG. 7. The wire 122 extends outwardly from the sliding block 112 and has a hook on the end thereof adapted for connection to an actuator.

Figure 5:
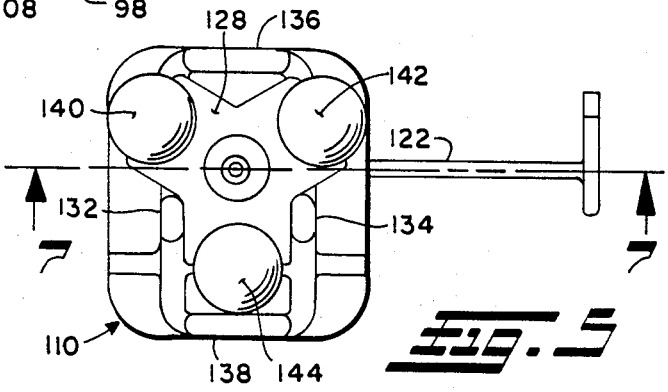
FIG. 5 is a plan view of the switch slider subassembly.
Figure 6:
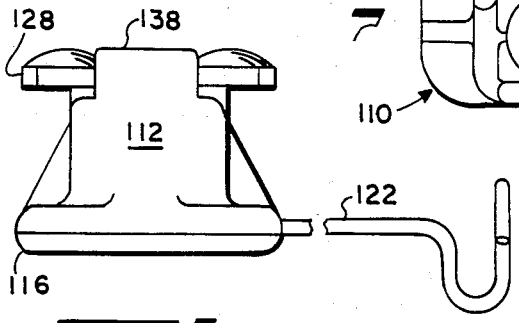
FIG. 6 is a front elevation view of the subassembly of FIG. 5.

An annular recess 124 is provided in the upper surface of the sliding block 112 and has received therein a suitable compression spring 126. A wiping plate 128 is provided having a generally "Y"-shaped configuration and is formed of electrically conductive material. With particular reference to FIGS. 5–7, plate 128 is received over post 130 provided centrally in the sliding block 112 and is oriented and positioned on the block by a plurality of guide lugs 132, 134, 136 and 138 extending upwardly therefrom. The plate 128 is biased upwardly by the spring 126 as shown by the dashed outline in FIG. 7 in which the plate 128 is shown in solid outline in the installed position with the spring 128 compressed downwardly.

The wiping plate 128 has a plurality, and preferably 3, spaced electrical wiping contacts 140, 142 and 144 formed thereon each having a preferably upwardly convex surface as shown in FIGS. 5–7. In the presently preferred practice, two of the contacts 140, 142 are disposed and spaced arrangement with a line through the centers thereof parallel to the ways 114, 116. The remaining terminal 144 is spaced from the alignment of the contacts 140, 142.

Referring now to FIG. 4, the wiper subassembly 110 is shown in the installed position as received in the body 12 with ways 114, 116 engaging the grooves 106, 108 respectively, in the bottom shell for guided sliding movement therein. In the installed position of subassembly 115, the contacts 140, 142 engage the common strip 92 and the contact 144 is positioned for engaging the contact strips 32, 30 and 28 for switching therebetween as the slider is moved longitudinally with respect to the housing.

In operation, as the wiper subassembly 110 is moved longitudinally, the contact 144 makes and breaks a circuit between the common strip 92 and one of the individual strips 28, 30 and 32 respectively.

The invention as described hereinabove with respect to the illustrated embodiments thus provides a unique and novel switching mechanism of the type have a sliding wiper contacting stationary terminal strip. The switching mechanism of the present invention enables a plurality of stationary contact strips to be formed on a unitary plate having frangible portions thereof interconnecting the contact strips. The plate is received in the switch housing and retained therein by deformation of portions of the housing. The frangible portions are then punched out to form a plurality of individual electrically isolated contact strips in the housing. The individual contact strips are contacted by a sliding wiper for performing switching functions with respect to a common stationary terminal strip.

Although the invention has hereinabove been described with respect to the embodiments illustrated in the drawings and the presently preferred practice, it will be understood to those skilled in the art that the invention is capable of modification and variation and is limited only by the following claims.

What is claimed:

1. A method of manufacturing an electrical switch comprising:

(a) providing a base of electrically insulating material;

(b) positioning and retaining on said base a plate of electrically conducting material having a plurality of individual contact forming regions thereon interconnected by frangible portions;

(c) breaking away said frangible portions and forming on said strip a plurality of electrically isolated contacts; and, (d) assembling on said base a wiper means moveable thereon for making and breaking contact between a plurality of said contacts.

2. The method defined in claim 1, wherein said step of providing includes forming said base of plastic material, and said step of positioning and retaining comprises heating and deforming portions of said plastic material over said strip.

3. The method defined in claim 1, wherein said step of positioning and retaining includes the step of deforming portions of said base over said plate.

4. The method defined in claim 1, wherein said step of providing includes forming said base of thermoplastic material and said step of positioning and retaining includes heating and deforming portions of said thermoplastic material over said plate.

5. The method in claim 1, wherein said step of positioning and retaining includes passing connector portions of said plate through apertures in said base and deforming portions of said base over said plate.

* * * * *